US006884064B1

(12) United States Patent
Cusick et al.

(10) Patent No.: US 6,884,064 B1
(45) Date of Patent: Apr. 26, 2005

(54) BURNER MECHANISM FOR A ROTARY KILN

(75) Inventors: Richard Cusick, Norcross, GA (US); John Schureck, Lilburn, GA (US)

(73) Assignee: KHD Humboldt Wedag AG, Cologne (DE)

( * ) Notice: Subject to any disclaimer, the term of this patent is extended or adjusted under 35 U.S.C. 154(b) by 0 days.

(21) Appl. No.: 10/706,159

(22) Filed: Nov. 12, 2003

(51) Int. Cl.[7] ..... F27B 7/34
(52) U.S. Cl. ..... 432/194; 432/103; 431/160
(58) Field of Search ..... 432/116, 103, 432/65, 245, 249, 194; 431/160, 189

(56) References Cited

U.S. PATENT DOCUMENTS

| | | | | |
|---|---|---|---|---|
| 4,090,841 A | * | 5/1978 | Kramlehner | 432/60 |
| 4,422,848 A | | 12/1983 | Musil | |
| 5,480,226 A | * | 1/1996 | Milstead | 366/7 |
| 6,279,566 B1 | * | 8/2001 | Craven, Jr. | 126/41 R |

FOREIGN PATENT DOCUMENTS

| | | |
|---|---|---|
| DE | 3324580 | 2/1984 |
| DE | 69218962 | 10/1997 |
| EP | 0919769 | 10/1998 |
| JP | 2001324273 | 11/2001 |
| WO | WO 95/30522 | 11/1995 |
| WO | WO 02/063212 | 8/2002 |

OTHER PUBLICATIONS

Brochure No. 7–330 Pyrostep® Die neue Generation wirtschaftlicher Rostkü;hler brochure by KHD Humboldt Wedag, dated prior to priority date.

* cited by examiner

*Primary Examiner*—Gregory Wilson
(74) *Attorney, Agent, or Firm*—Sonnenschein Nath & Rosenthal LLP

(57) ABSTRACT

A burner protection shield is provided at a distance and in an area below a burner lance that is used in a rotary kiln for the production of cement clinker. Such a mechanism enhances the useful lifetime of the burner lance.

12 Claims, 2 Drawing Sheets

14
S
L
16
19

10
11
14
II
II
12
13
16
15
17

BURNER MECHANISM FOR A ROTARY KILN

BACKGROUND OF THE INVENTION

The invention involves a burner mechanism for a rotary kiln for the production of cement clinker from raw meal, with a burner lance movable in an axial direction, which extends through the stationary kiln outlet housing into the rotary kiln end.

At standard cement clinker production lines, calcined raw meal is burnt to cement clinker in the sintering zone of a rotary kiln by means of a burner lance extended through the kiln outlet housing creating a flame by means of fuel combustion. The red hot cement clinker is discharged through the kiln outlet housing onto a clinker cooler, in most cases grate coolers, and will be cooled down. In modern cement clinker production lines, the hot cooler air collected in the kiln outlet housing is utilized twofold. First, the hot air used as secondary air for the kiln firing and second, as tertiary air for a secondary firing system in the calciner stage installed according to the material flow upstream of the rotary kiln (brochure No. 7-330 KHD Humboldt Wedag AG, page 4 and 5).

The secondary air, which changes flow direction upon entering the kiln outlet end through the stationary kiln outlet housing from below, is loaded with cement clinker dust and has a high temperature of 1,100° C. and higher. Therefore the kiln outlet housing, and especially the burner lance, is exposed to a high mechanical abrasive and thermo/chemical wear. There are cases where the lifetime of a burner lance is extremely short, even if the burner lance is coated with heat resistance material and has a cooling system. An exchange or replacement of the burner lance requires interruption of the kiln operation and consequently an interruption of the whole cement clinker production line.

SUMMARY OF THE INVENTION

The invention has as one of its benefits, to provide a burner mechanism to be used with a burner lance for a rotary kiln for the production of cement clinker, which will extend the lifetime of the burner lance.

With the invented burner mechanism, a removable and replaceable burner protection shield is located at a distance under the burner lance, which means the burner protection shield extends similarly to the burner lance, through the kiln outlet housing into the rotary kiln, from which the red hot clinker discharges through the kiln outlet housing onto the clinker cooler. Especially the bottom side of the burner lance is protected with the burner protection shield against the abrasive dust laden secondary air flowing from below towards the underside of the burner. Furthermore the protection shield protects the burner lance from the extreme heat radiation from the red hot cement clinker.

Due to the protection shield, it is possible to increase the life time of the kiln burner lance to up to a year.

A special feature of the invention is the fact that the burner protection shield is equipped with its own carriage device which makes it movable parallel to the burner lance. Once the protection shield is worn out it can removed from the kiln outlet housing and replaced with a new one. With this feature, the burner lance operation and the operation of the whole cement clinker production line does not have to be interrupted.

To secure the protection of the cylindrical burner lance, the width of the protection shield is greater than the diameter of the burner lance with the advantage that the burner lance is not exposed to the hot air current and radiation.

The burner protection shield is made of heat resistant material. Furthermore the protection shield features at least one cooling channel to introduce a cooling media, for instance cooling air. The heated up cooling air exiting the protection shield will be mixed with secondary air flowing into the rotary kiln or can be vented outside of the kiln hood.

The invention and the special features and advantages are being described using the schematic figures attached.

DETAILED DESCRIPTION OF THE PREFERRED EMBODIMENT

Figures 1, 2:
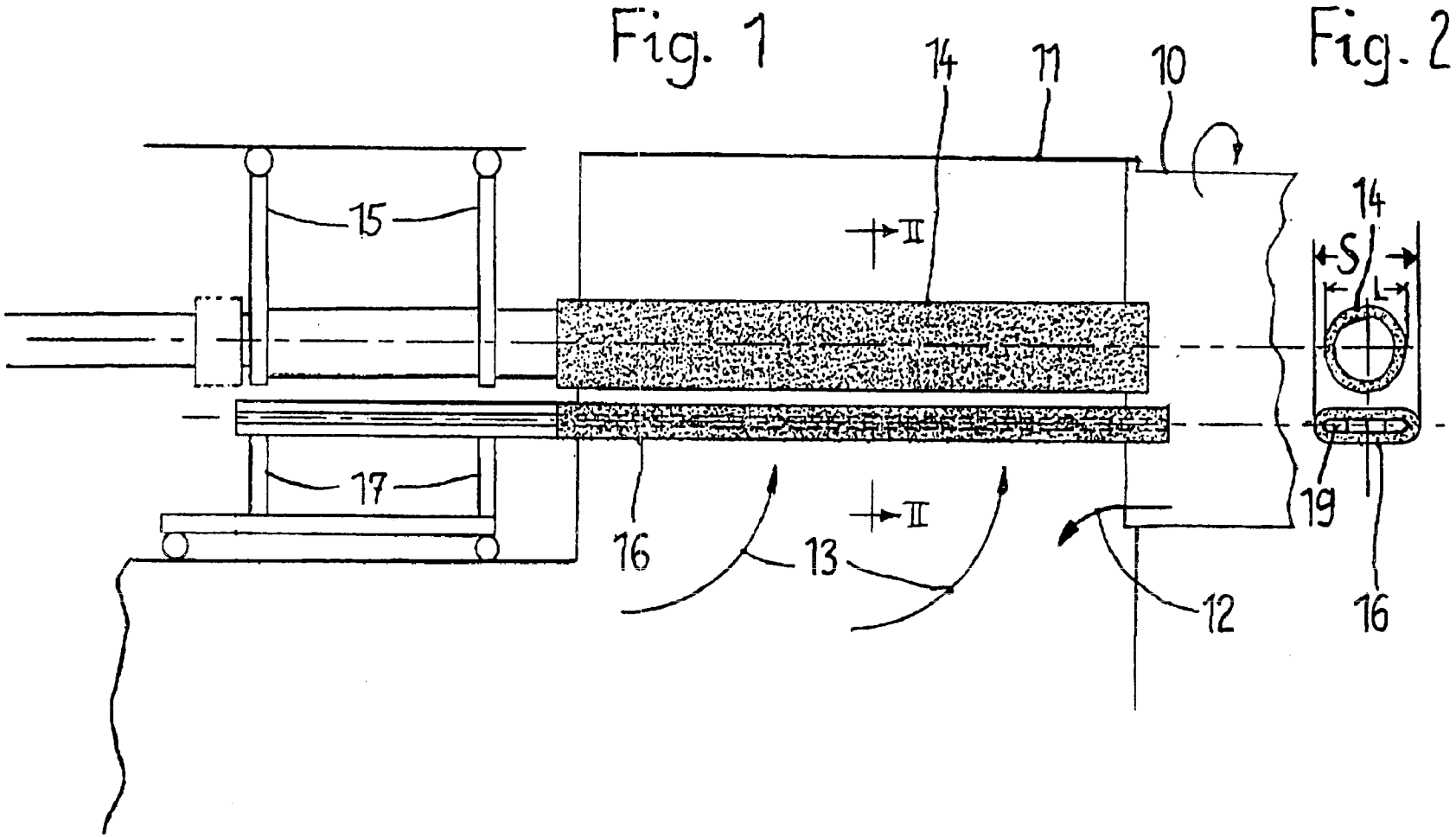
FIG. 1 illustrates a burner mechanism embodying the principles of the present invention with a protection shield, in a side elevational view.
FIG. 2 illustrates a cross section of the burner device of FIG. 1 taken generally along the line II—II.

In FIG. 1, an outlet end of a rotary kiln (10) of a cement clinker production line is surrounded by a stationary kiln outlet housing (11). A complete system for manufacturing cement clinker is shown and described in U.S. Pat. Nos. 6,626,662; 6,254,382 and 6,444,026, the disclosures of which are incorporated herein by reference. From the kiln outlet the red hot cement clinker (12) falls through the kiln outlet housing (11) down to the not shown clinker cooler. From the clinker cooler, hot cooler air laden with clinker dust flows as secondary air (13) through the stationary kiln outlet housing (1) into the rotary kiln (10). The rotary kiln (10) will be heated by a flame coming out of a burner lance (14) which extends through the outlet housing (1) into the kiln end. The burner lance can be moved in the axial direction with a movable carriage (15) mounted on rollers.

Positioned at a distance below and parallel to the burner lance (14) is an exchangeable (removable and replaceable) burner protection shield (16), which is similar to the burner lance, extends through the kiln outlet housing (11) into rotary kiln (10). The protection shield (16) which is movable parallel to the burner lance (14) by its own carriage (17) protects the burner lance (14), especially at the bottom part, against the flow of the hot clinker dust laden secondary air (13), as well as against the radiation of the red hot cement clinker (12). This prolongs the life time of the burner lance considerably.

In FIG. 2 it can clearly be seen that a width (S) of the burner protection shield (16) is advantageous greater than a diameter (L) of the burner lance (14) and therefore the lance (14) is located at the draft side of the of the protection shield with regard to air flow and heat radiation.

Figure 3:
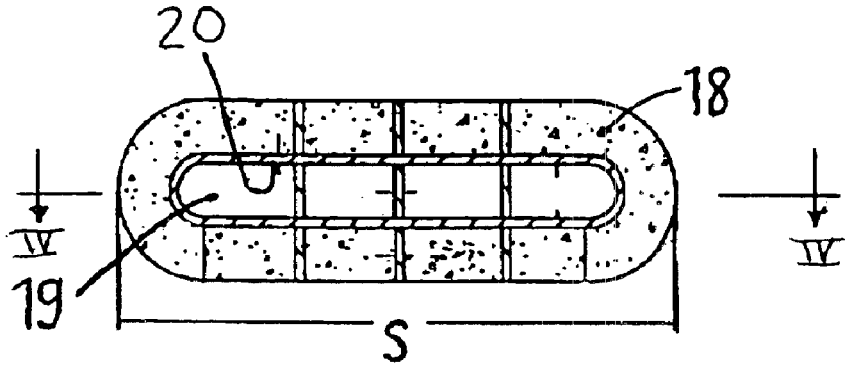
FIG. 3 illustrates in detail an enlarged cross section of the burner protection shield of FIG. 2.

As shown in FIG. 3, the burner protection shield (16) is comprised of heat resistance material (18) or coated with this material. This heat resistance material (18) can contain a metallic reinforcement (20). Furthermore it can be seen in FIG. 3 that the protection shield (16) has at least one cooling channel (19) for passage of cooling media, for example, cooling air. The cooling air passing through the cooling channel (19) of the protection shield (16), heats up, and flows out the right end of the protection shield as heated air into the rotary kiln (10) and mixes with the secondary air.

Figure 4:
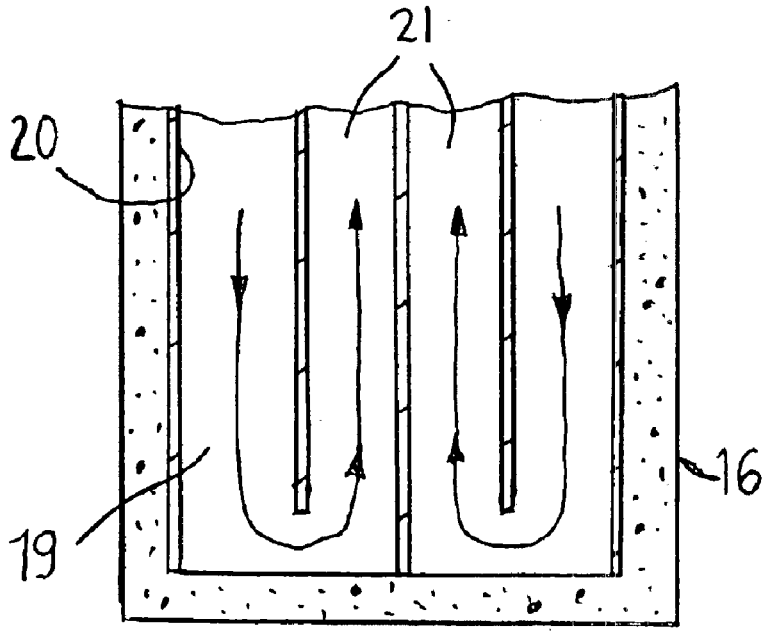
FIG. 4 illustrates a cross section of the burner protection shield, in an embodiment of the invention, taken generally along the line IV—IV of FIG. 3.

Alternatively, as shown in FIG. 4, to decrease false air and improve fuel efficiency, channel (19) can be re-directed back to the left and out of the kiln outlet housing (11) through the central segments (21) of the cooling channel (19).

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

What is claimed is:

1. A burner mechanism for a rotary kiln for the production of cement clinker from raw meal having an axially movable burner lance which extends through a stationary kiln outlet housing into an end of the rotary kiln comprising:

a replaceable burner protection shield extending through the stationary kiln outlet housing, located at a distance spaced below the burner lance in the stationary kiln outlet housing and extending less than fully around said burner lance.

2. The burner mechanism according to claim 1, wherein a width of the burner protection shield is greater than a diameter of the burner lance.

3. The burner mechanism according to claim 1, wherein the burner protection shield includes at least one cooling channel for passage of a cooling media.

4. The burner mechanism according to claim 3, wherein the cooling channel is arranged so that the cooling media is discharged from the burner protection shield into an area other than into the rotary kiln.

5. The burner mechanism according to claim 1, wherein the burner protection shield is comprised of a heat resistant material.

6. A burner mechanism for a rotary kiln for the production of cement clinker from raw meal having an axially movable burner lance which extends through a stationary kiln outlet housing into an end of the rotary kiln comprising:

a replaceable burner protection shield located at a distance spaced below the burner lance, wherein the burner protection shield is movable parallel to the burner lance by means of its own carriage.

7. A burner mechanism for a rotary kiln comprising:

an axially extending burner lance which extends through a stationary kiln outlet housing into an end of the rotary kiln, and a replaceable burner protection shield extending through the stationary kiln outlet housing and positioned substantially parallel to and at a distance below the burner lance in the stationary kiln outlet housing.

8. The burner mechanism according to claim 7, wherein a width of the burner protection shield is greater than a diameter of the burner lance.

9. The burner mechanism according to claim 7, wherein the burner protection shield includes at least one cooling channel for passage of a cooling media.

10. The burner mechanism according to claim 9, wherein the cooling channel is arranged so that the cooling media is discharged from the burner protection shield into an area other than into the rotary kiln.

11. The burner mechanism according to claim 7, wherein the burner protection shield is comprised of a heat resistant material.

12. A burner mechanism for a rotary kiln comprising:

an axially extending burner lance which extends through a stationary kiln outlet housing into an end of the rotary kiln, and a replaceable burner protection shield positioned substantially parallel to and at a distance below the burner lance, wherein the burner protection shield is movable parallel to the burner lance by means of its own carriage.

* * * * *